United States Patent [19]

Reese

[11] Patent Number: 4,966,740

[45] Date of Patent: Oct. 30, 1990

[54] TEXTURING POLYESTER YARNS

[75] Inventor: Cecil E. Reese, Kinston, N.C.

[73] Assignee: E. I. du Pont de Nemours and Company, Wilmington, Del.

[21] Appl. No.: 299,981

[22] Filed: Jan. 23, 1989

Related U.S. Application Data

[62] Division of Ser. No. 907,300, Sep. 12, 1986, Pat. No. 4,833,032.

[51] Int. Cl.[5] ..... D01D 5/22; D01D 5/12

[52] U.S. Cl. ..... 264/103; 264/168; 264/210.2; 264/210.6; 264/211; 264/210.8; 57/282; 57/288; 57/310

[58] Field of Search ..... 264/210.6, 210.8, 211, 264/103, 210.2, 168; 57/282, 288, 310

[56] References Cited

U.S. PATENT DOCUMENTS

| | | | |
|---|---|---|---|
| 3,335,211 | 8/1967 | Mead et al. | 264/211.24 |
| 3,771,307 | 11/1973 | Petrille | 264/288.8 |
| 3,772,872 | 11/1973 | Piazza et al. | 264/210.8 |
| 4,092,299 | 5/1978 | MacLean et al. | 264/210.8 |
| 4,113,704 | 9/1978 | MacLean et al. | 264/210.8 |
| 4,134,882 | 1/1979 | Frankfort et al. | 264/176.1 |

*Primary Examiner*—Hubert C. Lorin

[57] ABSTRACT

Modifying a polyester with tetraethyl silicate or like oxysilicon chain-brancher to provide a draw-texturing feed yarn that can be draw-textured at a speed of at least 500 mpm without excessive filament breaks, and with other advantages in the resulting textured yarns, such as improved bulk and dyeability over unmodified polyester yarns textured under similar conditions, and preferably without sacrificing dye uniformity.

3 Claims, 2 Drawing Sheets

TEXTURING POLYESTER YARNS

This is a division of application Ser. No. 06/907,300, filed Sept. 12, 1986, now U.S. Pat. No. 4,833,032.

TECHNICAL FIELD OF THE INVENTION

This invention concerns improvements in and relating to texturing polyester yarns, and is more particularly concerned with improved polyester draw-texturing feed yarns having a capability of being draw-textured at high speeds without excessive broken filaments and with other advantages, to such high speed process of draw-texturing, and to a process for preparing such feed yarns.

BACKGROUND OF THE INVENTION

The preparation of textured polyester multifilament yarns has been carried out commercially on a worldwide scale for many years. The simultaneous draw-texturing by a false-twist texturing process of partially oriented feed yarns of low crystallinity prepared by spin-orienting, i.e., withdrawing the melt-spun polyester filaments at high withdrawal speeds of, e.g., 3,000 ypm, was disclosed by Petrille in U.S. Pat. No. 3,771,307, and the feed yarns were disclosed by Piazza and Reese in U.S. Pat. No. 3,772,872. Use of these spin-oriented feed yarns has made possible significant increases in texturing speeds. In about 1970, commercially-available texturing machines (false-twist texturing) were capable of maximum speeds only of the order of about 200 mpm (meters per minute). For several years now, owing to improvements in machinery design, draw-texturing machines have been commercially available with a capability of operating at very high speeds of, e.g., 1,000 mpm or more. Despite the availability of such machines, capable of machine operation at such desirable very high speeds, commercially-available draw-texturing polyester feed yarns (DTFY) have not been textured commercially at the very high speeds of which the machines are capable. This is mainly because of the excessive number of broken filaments produced at these very high speeds. Any broken filaments are undesirable, since they may cause difficulties, and even yarn breaks, during subsequent processing, and also fabric defects. The number of broken filaments that may be tolerated in practice will depend upon the intended use for the textured yarn and eventual fabric. In practice, in the trade, the ends of the bobbin are examined for broken filaments, and the number of protruding broken filaments is counted so as to give a measure of the probable number of broken filaments in the yarn of that package. The total number of these broken filaments counted is then divided by the number of pounds in the package and expressed as BFC. For certain end uses, the maximum that can be tolerated is between 0.5 and 0.6 BFC, i.e., between 5 and 6 broken filaments for every 10 lbs. of polyester yarn, it being understood that one break will probably count as two broken filaments. Thus, for any texturer having a texturing machine capable of operation at 1,000 mpm or more, if the polyester draw-texturing feed yarns commercially available cannot be processed on this machine at more than about 850 mpm without significantly exceeding the desired maximum (e.g.,about 0.5 BFC), he will be forced in practice to operate his machines at this speed of 850 mpm instead of increasing the speed to the maximum capability of the machine. Despite the obvious commercial incentive to provide polyester draw-texturing feed yarns capable of being draw-textured at speeds of more than 1,000 mpm without excessive BFC, however, hitherto, this problem of providing a commercially-satisfactory feed yarn has not yet been solved.

I have found it possible to increase texturing speeds without causing excessive broken filaments by increasing the withdrawal speed used to obtain the desired spin-orientation in the feed yarn. Such feed yarns, prepared at relatively high withdrawal speeds of 4,000 mpm, have not been textured commercially on a large scale because of accompanying disadvantages, mainly that the resulting textured yarns have not been as bulky as yarns that are already available commercially. Bulk is generally measured as CCA, a value of at least about 4 being considered desirable, or as TYT, a value of over 20 being considered desirable, generally, at this time.

The problem that has faced the industry, therefore, has been to provide a polyester multifilament draw-texturing feed yarn (DTFY) that is capable of being draw-textured on existing commercial machines at a speed of at least 1,000 mpm and yet of providing a package of textured yarn with, by way of example, not more than about 0.5 BFC and over 20 TYT, it being understood that such figures depend very much on economic and other commercial considerations and on what competitors are prepared to offer at any time. Generally, with the passage of time, the demands of any industry tend to increase.

SUMMARY OF THE INVENTION

The present invention provides a solution to this problem. In one aspect of the invention, there is provided a process whereby an improved new polyester feed yarn can be draw-textured at high speeds to give yarns of satisfactory texture without excessive BFC. In another aspect, improved new polyester feed yarns are provided, whereby this problem can be solved. In a further aspect, there is provided a process for preparing these improved new feed yarns. In a further aspect, use of the feed yarns can provide other advantages, even when increased speed of texturing is not necessary or desirable.

According to one aspect of the invention, there is provided a continuous process for preparing polyester draw-texturing feed yarns, involving the steps of first forming a molten polyester by reaction (a) of ethylene glycol with terephthalic acid and/or esters thereof, followed by polycondensation (b), these reaction steps being carried out in the presence of appropriate catalysts therefor, and then melt-spinning the resulting molten polyester into filaments and withdrawing them at a speed of about 3,000 to 4,000 mpm, preferably at speeds in the lower portion of this range, such as about 3,000 to 3,200 mpm, to provide partially oriented yarns of low crystallinity, wherein the polyester is modified by introducing into the polymer, as a solution in ethylene glycol, tetraethyl silicate or like oxysilicon chain-brancher (TES) in amount as indicated approximately by the line AB of FIG. 1 of the accompanying drawing.

According to another aspect of the invention, there is provided a partially oriented polyester multifilament draw-texturing feed yarn of low crystallinity, as shown by a boil-off shrinkage of about 45% and an elongation to break of about 155%, consisting essentially of polymerized ethylene terephthalate residues chain-branched with TES residues in amount about 6 MEQ, and of relative viscosity about 21 LRV. Alternatively, the boil-off shrinkage may be about 20–25%, the elongation to break about 133%g, and the amount of TES residues about 4 MEQ. The elongation (to break) is a measure of orientation (as is birefringence), the elongation being reduced as the spin-orientation is increased, while the shrinkage is affected by the crystallinity, as well as the orientation, and is reduced as the crystallinity increases. Thus, there is provided a multifilament draw-texturing feed yarn that has been prepared by polymerizing ethylene and terephthalate derivatives with TES residues acting as chain-brancher and by spin-orienting at a withdrawal speed of at least about 3,000 to 4,000 mpm, preferably a lower speed, such as about 3,000 to 3,200 mpm, and that is capable of being draw-textured at a speed of at least 1,000 mpm to provide a package of textured yarn with not more than about 0.5 BFC and a TYT of over 20.

According to a further aspect of the invention, there is provided a process for preparing a false-twist textured yarn, wherein a multifilament polyester feed yarn is subjected to simultaneous draw-texturing at a speed of at least 500 mpm, the feed yarn consists essentially of polymerized ethylene terephthalate residues and of TES residues acting as a chain-brancher and the resulting package of textured yarn has not more than about 0.5 BFC and over 20 TYT.

As will be apparent, the new feed yarns and their process of preparation make possible the provision of textured polyester yarns having increased dye-uptake and/or improved crimp, as compared with prior commercial polyester yarns textured under comparable conditions.

As will be explained hereinafter with reference to the drawings, the amount of chain-brancher will depend on various considerations, especially the spinning speed, since it will generally be desirable to use as much chain-brancher as possible to obtain increased advantages in certain respects, whereas the amount should not be so much as will cause spinning difficulties, and this will depend on the withdrawal speed in the sense that the desired amount of chain-brancher will be reduced as the withdrawal speed is increased. Furthermore, an advantage in dye uniformity of the textured yarns (and fabrics) has been obtained by withdrawing the filaments of the feed yarns at lower speeds within the speed range indicated.

DESCRIPTION OF THE PREFERRED EMBODIMENTS

Figure 1:
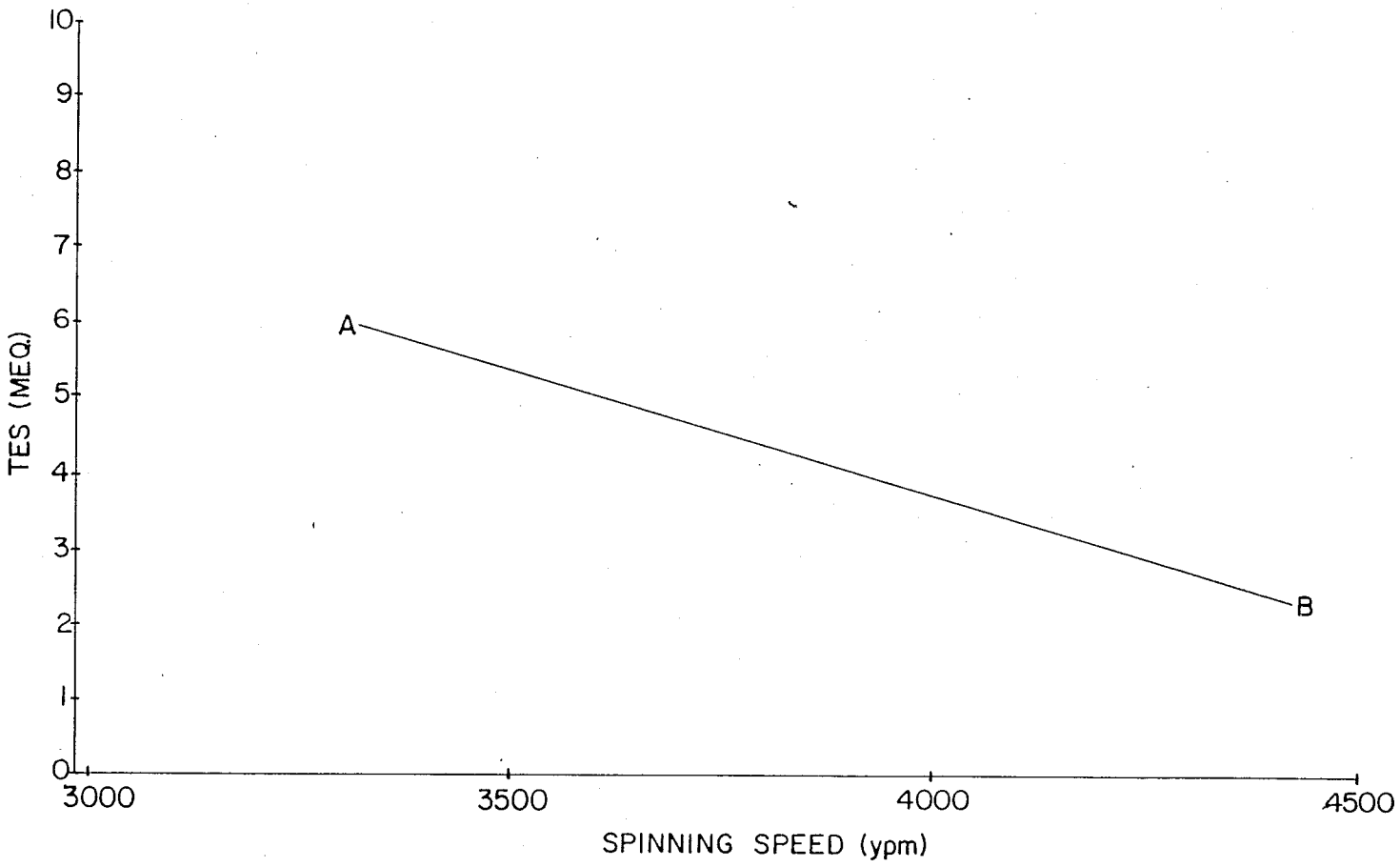
FIG. 1 is a graph showing the relationship of the withdrawal speed in ypm and the amount of chain-brancher in MEQ.

The preparation of the feed yarn is preferably by a continuous process in which the steps of polymerization and spinning are coupled together, because the alternative process that has been carried out in some plants of first making the polyester and then extruding it in the form of ribbons which are cooled with water and cut into pellets or flakes, which are then remelted for a separate process of spinning into filaments, will hydrolyze the oxysilicon chain-brancher, which is not desired at this stage.

The use of TES in polyester polymers has already been suggested for different purposes, especially the production of low viscosity polyester staple fibers to improve the pill resistance of fabrics, e.g., in Mead and Reese U.S. Pat. No. 3,335,211. For this different purpose, the TES was incorporated during the formation of the polyester in similar manner. Also, the importance of maintaining the polyester anhydrous prior to spinning was emphasized (bottom of column 3), preferably by avoiding a remelt operation. However, after forming the polyester fibers, they are exposed to moisture, when hydrolysis takes place, thus sharply reducing the viscosity of the polyester fibers. This was of advantage for the different purposes of the prior art, and is also of advantage according to the invention, as will be explained.

Tetraethyl silicate, or more properly tetraethyl orthosilicate is readily available commercially, and is consequently preferred for use as chain-brancher in accordance with this invention, but it will be recognized that other hydrocarbyl oxysilicon compounds can be used, as disclosed in U.S. Pat. No. 3,335,211 the disclosure of which is hereby incorporated by reference. For convenience, this preferred chain-brancher will be referred to hereinafter as TES, it being recognized that the other equivalent oxysilicon chain-branchers may be used.

An important element of the invention is believed to be the use of TES in small amounts (e.g. 4–6 MEQ) as a chain-brancher in the process of preparation of the polyester, which is accordingly a copolymer. It is believed that such chain-branching has not previously been used commercially for the objective of producing a feed yarn capable of being draw-textured at high speeds, e.g., of 1,000 mpm, without excessive broken filaments, e.g., not more than about 0.5 BFC, while giving desirably bulky yarns, e.g. of TYT over 20. It is not, however, new to suggest the use of chain-branchers for other purposes. For instance, MacLean et al., U.S. Pat. No. 4,092,299 suggests a high draw ratio polyester feed yarn and its draw-texturing and companion U.S. Pat. No. 4,113,704 suggests a polyester filament-forming polymer and its method of production. Since the two disclosures are practically identical, only U.S. Pat. No. 4,092,299 will be discussed.

MacLean et al., U.S. Pat. No. 4,092,299 suggests improving productivity by using a polyfunctional chain-brancher such as pentaerythritol. The increased productivity is obtained by increasing the draw ratio during draw-texturing and/or increasing the withdrawal speed during filament formation, because the orientation (birefringence) of the feed yarn is reduced by using chain-brancher. Pentaerythritol is suggested as the preferred chain brancher, but is not desirable according to the present invention, because it volatizes during polymer preparation. We have found that use of such volatile chain-brancher leads to problems and consequential lack of uniformity in the resulting filaments for the draw-texturing feed yarns. Although a volatile chain-brancher, such as pentaerythritol, may be quite adequate for operation at low texturing speeds and for MacLean's objective of increasing productivity, it is not a solution to the problem of providing a draw-texturing feed yarn capable of draw-texturing at a speed of, e.g., 1,000 mpm without excessive broken filaments, e.g., not more than about 0.5 BFC, while giving a desirably bulky yarn, e.g., over 20 TYT. It must be emphasized that uniformity of the polyester filaments in the feed yarn is of great importance in achieving high draw-texturing speeds without excessive broken filaments.

According to the present invention, we have found it desirable to use a chain-brancher that is adequately stable (both in monomer form during processing and polymerization and in polymeric form during formation of the polymer and spinning into filaments and subsequent processing), not so volatile as to cause problems and variability during preparation of the polymer, and that is soluble in the catalyzed glycol for ease of addition to the reaction ingredients. TES fulfills all these functions, provided hydrolysis is avoided, as is ensured during normal continuous polymerization coupled with melt-spinning.

MacLean is not limited to the use of pentaerythritol, but covers other chain-branching agents having a functionality greater than 2, that is containing more than 2 functional groups such as hydroxyl, carboxyl or ester. Accordingly, other wholly organic polyhydroxy chain branchers and aromatic polyfunctional acids or their esters are mentioned (column 7). MacLean does not suggest oxysilicon compounds or any other materials that contain inorganic moieties, or that are subject to hydrolysis like TES.

As will be seen in the Examples, hereinafter, wherein the DMT ester interchange route is used to prepare the polyester, the chain-brancher is conveniently dissolved in the catalyzed EG solution that is used in an otherwise conventional ester interchange reaction between DMT and EG using appropriate catalysts to prepare the prepolymer. Further polymerization (sometimes referred to as finishing) is carried out under vacuum with an appropriate material such as phosphorus again in conventional manner to prepare a polymer of the required viscosity (measured as LRV). The resulting polymer is then passed continuously to the spinning unit without permitting intermediate hydrolysis, and is spun to prepare partially oriented filaments of low crystallinity at withdrawal speeds of 3,000 mpm or more, with particular care in the spinning conditions to provide uniform filaments, to minimize breaks during the spinning or during subsequent draw-texturing operations at high speed.

TES has four reactive groups of which two are reacted in the molecular chain. One other reacts to form a side chain which is referred to as a chain branch. If the other or if these chain branches react with another molecule, a crosslink is formed. Because there are four of these reactive sites in TES, there are two available for chain branching. Therefore, the equivalent weight is half the molecular weight. 4 MEQ are approximately 0 043% by weight of TES (430 ppm), whereas 6 MEQ are almost 0.065% (650 ppm).

As indicated above, and herein elsewhere, the amount of chain-brancher must be carefully adjusted, especially according to the withdrawal speed, if the full benefits of the invention are to be obtained. Optimum amounts are indicated graphically as the line AB in FIG. 1 of the accompanying drawings, plotting such optimum amounts (as MEQ) against the withdrawal speeds (in ypm) for the equipment that I have used. It will be understood that some variation can be permitted, and the exact optimum may well differ according to various factors, such as the ingredients and equipment used to make the polymer and the yarns, and operating preferences. However, as the amount of chain-brancher increases, so does the melt viscosity generally increase, and this soon causes problems, particularly in spinning, so that spinning becomes impossible because of melt fracture. However, it is generally desirable to use as much chain-brancher as possible, consistent with the above, so as to obtain the indicated benefits in the textured yarns, especially of increased crimp and dye-uptake over yarns of unmodified polymer. Thus there is a rather narrow range of proportions of chain-brancher within which I prefer to operate. As indicated, this range decreases with the withdrawal speed used to make the DTFY, since the melt viscosity increases, and accordingly spinning problems increase with increased speeds. Furthermore, the dye uniformity of the textured yarn has been better when lower withdrawal speeds have been used within the indicated range. If this is important, a withdrawal speed that is relatively low within the operational range is preferred, i.e. less than 3,500 mpm, and especially about 3,000 to 3,200 mpm. This preferred relatively low speed is surprising, being contrary to what I had expected from my knowledge of this field and of the teaching in the art. However, the speed should not be too low, since this will lead to filaments that are unstable to heat, and that may cause problems of fusing together or melting on the (first) heater of the texturing machine, or of string-up. In this respect the desirable minimum withdrawal speed is significantly more than taught by Petrille and by Piazza and Reese in U.S. Pat. Nos. 3,771,307 and 3,772,872 for unmodified (homopolymer) PET yarns. As indicated already, and is well known, the elongation (to break) generally decreases as the withdrawal speed increases, being a measure (inverse) of the orientation. Thus an increase in elongation (other parameters being kept constant) generally indicates a tendency to instability of the filaments to heat, whereas a decrease in elongation similarly indicates less dye uniformity. It will be understood that all the numerical parameters expressed herein will depend on the ingredients, equipment and operating preferences to some extent. The preferred value of 21 for the LRV is because too high a value will increase the melt viscosity and this leads to spinning problems, as already explained. Too low an LRV, however, tends to reduce the tensile properties, especially the toughness of the filaments, and this leads to breaks during draw-texturing. Similarly, if the shrinkage is too low, this indicates too much crystallinity, and leads to variability, which generally shows up first as reduced dye-uniformity, whereas insufficient crystallinity (too high a shrinkage) leads to variability in other respects, and can produce filaments that are not sufficiently stable to heat, as indicated above. So it will be understood that the spinning conditions must be carefully monitored, and the desired amount of chain-brancher must be carefully selected, and is affected by the speed of withdrawal, which may be selected according to the properties desired in the eventual textured yarns. If dye uniformity is essential, then a lower speed of about 3,000 mpm may be preferred. If better crimp properties are more important, then higher withdrawal speeds may be preferred. As the withdrawal speed rises, however, there comes a point when the presence of chain-brancher does not apparently continue to improve crimp properties, although other advantages, such as of improved dye-uptake will still apply.

The use of chain-brancher has been noted to provide significantly higher spinning tensions, than with unmodified polymer. This is believed to be an important advantage in the process of the invention. TES provides a particular advantage in that, after filament formation, hydrolysis takes place, as explained in U.S. Pat. No. 3,335,211 and the relative viscosity is thereby reduced and the molecules are not tied together, so it is easier to orient them and consequently the force to draw is reduced. This is of advantage during subsequent draw-texturing.

As indicated, an important advantage in the resulting textured yarns, obtained by draw-texturing of the improved modified feed yarns of the present invention, is the low number of broken filaments (BFC) obtained even when the texturing is carried out at the very high speeds indicated. The resulting textured yarns also have other advantages. As can be seen from the Examples herein, the dyeability, or dye-uptake, is improved. This, in retrospect, may not seem so surprising, since there have been several prior suggestions of using other polyfunctional chain-branching agents in polyester polymers in much larger amounts in order to obtain better dyeability, oil-stain release or low pilling, as mentioned in column 1 of MacLean. However, despite these general suggestions of improving such properties in the prior art, it is believed that no one has previously actually made a textured polyester fiber of improved dyeability by incorporating a TES chain brancher in the polymer used to make the DTFY.

A further improvement in the textured yarns, believed to be a result of the chain-branching according to the invention, is the improved crimp properties, as shown by the CCA and TYT values in the Examples. This is an important advantage commercially. In practice, it is necessary to operate the draw-texturing process so as to obtain textured yarn having at least equivalent crimp properties to those that are already available commercially. The crimp properties can be adjusted to some extent by varying the draw-texturing conditions, and this can also depend on the skill and knowledge of the texturer, who may be forced to reduce the texturing speed in order to improve the crimp properties of the resulting textured yarn. Thus, a desirable objective for the texturer is to achieve or surpass the target crimp properties, while reducing his costs by operating at the maximum possible speed.

The invention is further illustrated in the following Examples. The yarn properties are measured as in U.S. Pat. No. 4,134,882 (Frankfort and Knox) except as follows.

BFC (Broken Filament Count) is measured as indicated hereinabove in number of broken filaments per pound of yarn. In practice, a representative number of yarn packages are evaluated and an average BFC is obtained by visually counting the total number of free ends on both ends, and dividing by the total weight of yarn on these packages.

TYT (Textured Yarn Tester) measures the crimp of a textured yarn continuously as follows. The instrument has two zones. In the first zone, the crimp contraction of the textured yarn is measured, while in the second zone residual shrinkage can be measured. Only the first zone (crimp contraction) is of interest, however, for present purposes. Specifically, the textured yarn is taken off from its package and passed through a tensioning device which increases the tension to the desired level, 10 grams for 160 denier yarn (0.06 gpd). The yarn is then passed to a first driven roll, and its separator roll, to isolate the incoming tension from the tension after this first roll. This roll is hereafter referred to as the first roll. Next, in this first zone, the yarn is passed through a first tension sensor, and through an insulated hollow tube, which is 64.5 inches (~164 cm) long and 0.5 inches (1.27 cm) in diameter and which is maintained at 160° C., to a second set of rolls, a driven roll and a separator, which isolate the tension in the yarn in the first zone from that in the next zone, and to a third set of rolls, a driven roll and a separator roll, which further isolates the tension in zone one from the tension in zone two. The circumferential speed of roll three is set enough faster than roll two so that roll two imparts 2 grams tension to a 160-denier threadline (~0.013 gpd), and rolls two and three are controlled by the first tension sensor at such speeds as to insure that the tension in zone one is that desired, (~0.001 gpd). When the yarn leaves the third set of rolls, it is passed through a second sensor and thence to a fourth set of rolls which isolate the tension in the second zone from any windup tension or waste jet. The speed of the fourth set of rolls is controlled by the second sensor and that tension is set at 10 grams for a 160-denier yarn or 0.0625 gpd. Of course, the total tensions will change with a change in denier of the textured yarn. As indicated, only the relative speeds in and out of the first zone are of interest in this instance.

The TYT is calculated as a percentage from the circumferential speeds $V_1$ of the first roll and $V_2$ of the second roll:

$$TYT = \frac{V_1 - V_2}{V_1} \times 100$$

CCA (Crimp Contraction) of textured yarns is determined in the following manner: A looped skein having a denier of 5,000 is prepared by winding the textured yarn on a denier reel. The number of turns required on the reel is equal to 2,500 divided by the denier of the yarn. A 500 gm. weight is suspended from the looped skein to initially straighten the skein. This weight is then replaced by a 25-gram weight to produce a load of 5.0 mg/denier in the skein. The weighted skein is then heated for 5 minutes in an oven supplied with air at 120° C., after which it is removed from the oven and allowed to cool. While still under the 5.0 mg/denier load, the length of the skein, $L_c$, is measured. The lighter weight is then replaced by the 500-gm. weight and the length of the skein, $L_e$, is measured again. Crimp Contraction is then expressed as a percentage which is calculated by the formula:

$$CCA = \frac{L_e - L_c}{L_e} \times 100$$

Dye Uptake—Each yarn was knitted into a tubing using a Lawson Hemphill FAK knitter. The knit tubing was scoured, dyed at 265° F. using Eastman Polyester Blue GLF (Dispersed Blue 27 No. 60767), rescoured, dried, flattened and the light reflectance of the various sections of the tubing measured with a "Color Eye Instrument", which is marketed by the Macbeth Corporation. Reflectance values are converted into K/S values using the Kubelka-Munk function, which is the theoretical expression relating reflectance of dyed yarn (in this case in tubing), to the concentration of the dye in the fiber. Sections of a "control yarn" are knitted into each tubing so that all K/S values can be rationalized, i e., expressed in "% Dye Uptake" vs. this control as standard.

EXAMPLE 1

A. Copolymer for the new and improved feed yarn for draw texturing (DTFY) is prepared by copolymerizing dimethyl terephthalate (DMT), ethylene glycol (EG) and about 4.8 MEQ tetraethyl silicate (TES) (about 4.8 microequivalents per gram of DMT). 4.8 MEQ is 0.050% of TES per gram of copolymer. The TES is dissolved in and added with the catalyzed glycol. At the concentration required, the TES is completely soluble in the catalyzed glycol and neither enhances nor inhibits the catalytic properties of the manganese and antimony salts which are used as catalysts. Catalyst contents are identical to those used for standard PET. The required amount of phosphorus, either as an acid or salt, is added when the exchange is complete and before proceeding with polymerization to inactivate the manganese catalyst during polymerization. 0.3% of $TiO_2$ based on DMT is added, as a glycol slurry to the material, after the exchange is complete and before the polymerization, to provide opacity in the resulting DTFYs. It is found that the addition, exchange and polymerization process conditions used for standard PET are acceptable. Indeed, the polymerization proceeds faster for the new copolymer. In the preparations used herein, both the copolymer and the standard (linear polymer) PET (used as control) were prepared in a continuous polymerization process. It is found that the resulting new copolymer has a LRV slightly higher than that of the control, somewhat more than 21 vs. standard polymer of about 20.5. The new copolymer also had a slightly higher melt viscosity than the control. This increased melt viscosity was not enough to cause problems in polymer making, polymer transport or spinning. The polymer is pumped from the continuous polymerizer to the spinning machines where it is spun into the new and improved feed yarn for draw texturing.

The new copolymer is pumped through a filter pack and thence through a spinneret which has 34 capillaries, each 15 x 60 mils (diameter x length). Spinning temperatures are somewhat higher than those required for standard PET (about 300° C. vs. about 293° C. for the standard PET). The extruded filaments are quenched by passing room temperature air across the filaments below the spinneret, using the same cross-flow system as for the standard PET filaments. The amount of air flow across the filaments is adjusted to obtain the best operability. Finish is applied after the filaments are quenched. Filaments are then converged into a threadline and handled as a threadline thereafter. This threadline is passed at 4,000 ypm (3,600 mpm) around the first godet, called a feed roll, thence to a second godet, called a let-down roll, through an interlace device and thence to an appropriate wind-up at about 4,000 ypm. The circumferential speed of the let-down godet is adjusted to give the tension between the feed and let-down godets that provides the best spinning continuity. These conditions were essentially the same as for standard yarn. Spinning continuity was found to be excellent. Packages of the new DTFY were judged to be at least as good as those from the standard yarn.

B. A similar copolymer is prepared, following essentially the same procedure, except that only 2.9 MEQ of TES are used (0.030%). No problems are again encountered in making or spinning the polymer into filaments.

The new DTFY A and B have tensile and other physical properties that are acceptable for DTFY. These properties are set out and compared with standard PET control DTFY in Table IA. The crystallinity values (density and C.I.) of the new DTFY are greater than the control.

Each DTFY is textured on a laboratory model, Barmag FK6-900 texturing machine, which is equipped for friction false twist texturing, with as disc stack a Barmag T-6 arrangement, using a 0-9-0 array of "Kyocera" ceramic discs with a spacing of 0.75 mm. Texturing speed comparisons are made over the speed range from 850 to 1,150 mpm, incremented in 100 mpm intervals. The draw ratio to avoid surging for each yarn is determined and used. The temperatures of the first and second heater plates are set at 220° C. and 190° C., conditions used by the many in the trade for PET yarns. During texturing, practically no breaks occurred with the new yarns at any of these speeds. In contrast, there were always more breaks for the control yarn, especially at higher speeds. The numbers of breaks when texturing these control yarns were not acceptable, but enough yarn was obtained to measure properties. It is very significant that the BFC at all these texturing speeds of the preferred new yarn (one containing about 4.9 MEQ) is at least equal to the BFC of the control textured at 850 mpm, the upper limit of speed used by the trade today. The pre-disc and the post-disc tensions were measured for each yarn at each texturing speed. The textured yarns are tested for textured yarn properties of broken filaments (BFC), and TYT and CCA crimp (bulk) properties and Dye Uptake with the results summarized in Table IB. These results show that the preferred new DTFY A has very substantial advantages vs. the control yarn in the very important property of broken filaments (BFC), higher crimp properties (TYT and CCA), and significantly greater dye uptake, and that DTFY B is inferior to DTFY A, because of the different content of chain-brancher, but is still superior to the control, especially in BFC at 1,150 mpm. (Clearly, there was some anomaly in that the results at 1,050 mpm should not be worse than at 1,150 mpm, but all these results are reported so as to provide full disclosure).

When an attempt was made to repeat Example 1 with higher amounts of TES (7.4 and 9.8 MEQ), there were no difficulties in polymer preparation, but the viscosity of the resulting polymer was increased to an extent that difficulties were encountered in transporting the polymer to the spinning machine and, especially, in spinning continuity. Even when the usual steps were taken to improve spinning continuity, the results were poor, many broken filaments were obtained and full packages could not be wound, especially for the Sample at 9.8 MEQ. This shows the importance of selecting the correct amount of chain-brancher. By repeating the preparation of DTFY in this way at various withdrawal speeds and concentrations (MEQ) of TES, the optimum relationship shown in FIG. 1 has been derived. As the speed is reduced, there are advantages in dye uniformity and in that the amount of TES can be increased (more than at higher speeds) without suffering these problems of continuity. An increase in the amount of TES generally leads to better texturing results.

TABLE 1A

| IDENTIFICATION | | CONTROL | NEW YARN A | NEW YARN B |
|---|---|---|---|---|
| TES (MEQ) | | 0 | 4.8 | 2.9 |
| COUNT | | 235-34-R | 250-34-R | 250-34-R |
| SPIN SPEED | (YPM) | 4000 | 4000 | 4000 |
| | (MPM) | 3600 | 3600 | 3600 |
| SPUN YARN PROPERTIES | | | | |
| DENIER | | 235 | 249 | 249 |
| MODULUS | | 29 | 26 | 28 |

TABLE 1A-continued

| IDENTIFICATION | CON-TROL | NEW YARN A | NEW YARN B |
|---|---|---|---|
| TENACITY | 2.67 | 2.21 | 2.50 |
| ELONGATION | 102 | 138 | 125 |
| T(BREAK) | 5.39 | 5.26 | 5.62 |
| BOS | 51 | 26 | 31 |
| BIREFRINGENCE | 0.0506 | 0.0353 | 0.0407 |
| DENSITY | 1.3418 | 1.3465 | 1.3458 |
| CI | 5.7 | 9.6 | 9 |
| INTERLACE (CM) | 9 | 9 | 9 |

TABLE 1B

| IDENTIFICATION | CON-TROL | NEW YARN A | NEW YARN B |
|---|---|---|---|
| TES (MEQ) | 0 | 4.8 | 2.9 |
| FEED YARN SPIN SPEED | 4000 YPM 3600 MPM | 4000 YPM 3600 MPM | 4000 YPM 3600 MPM |
| TEXTURING SPEED | | 850 MPM | |
| DRAW RATIO | 1.45 | 1.63 | 1.59 |
| PRE-DISC TENSION (GMS) | 72 | 75 | 77 |
| POST-DISC TENSION (GMS) | 86 | 83 | 87 |
| TEXTURED YARN PROPERTIES | | | |
| BCFs | 0.37 | 0.24 | 0.33 |
| TYT | 25.0 | 28.0 | 27.6 |
| CCA | 4.5 | 5.5 | 5.1 |
| DYE UPTAKE | 91 | 132 | 101 |
| TEXTURING SPEED | | 950 MPM | |
| DRAW RATIO | 1.47 | 1.63 | 1.59 |
| PRE-DISC TENSION | 78 | 77 | 75 |
| POST-DISC TENSION | 92 | 87 | 86 |
| TEXTURED YARN PROPERTIES | | | |
| BCF | 0.47 | 0.27 | 0.31 |
| TYT | 22.2 | 25.7 | 25.4 |
| CCA | 4.1 | 5.2 | 4.7 |
| DYE UPTAKE | 89 | 137 | 108 |
| TEXTURING SPEED | | 1050 MPM | |
| DRAW RATIO | 1.56 | 1.67 | 1.67 |
| PRE-DISC TENSION | 85 | 87 | 91 |
| POST-DISC TENSION | 92 | 97 | 106 |
| TEXTURED YARN PROPERTIES | | | |
| BCF | 0.57 | 0.34 | 0.49 |
| TYT | 21.2 | 23.6 | 23.7 |
| CCA | 3.9 | 4.3 | 4.1 |
| DYE UPTAKE | 80 | 127 | 92 |
| TEXTURING SPEED | | 1150 MPM | |
| DRAW RATIO | 1.63 | 1.75 | 1.67 |
| PRE-DISC TENSION | 119 | 93 | 86 |
| POST-DISC TENSION | 148 | 108 | 109 |
| TEXTURED YARN PROPERTIES | | | |
| BCF | 2.00 | 0.27 | 0.38 |
| TYT | 19.1 | 21.9 | 21 |
| CCA | 3.0 | 3.9 | 3.8 |
| DYE UPTAKE | 70 | 109 | 91 |

EXAMPLE 2

Tables 2A and 2B show that the performance of the new DTFYS change when the content of the TES is changed. Example 1 is repeated several times, each with a different concentration of TES and at each concentration the spinning speed is set at first 3500 ypm, then 4000 ypm and finally at 4500 ypm. There are no problems in polymer preparation or polymer transport. In these comparisons the spinning throughput was held constant. There are no problems in spinning at the lower concentrations and lower spinning speeds. However, as the concentration of TES is increased, spinning becomes more and more difficult at each speed and especially at the higher speeds. At the concentration of 7.2 MEQ it was very difficult to spin at 4500 ypm, and at 9.6 MEQ conditions were not found which would allow even a small amount of yarn to be wound at 4500 ypm. Even at 4000 ypm at these concentrations of 7.2 MEQ and 9.6 MEQ, spinning was difficult; the yarn containing 7.2 MEQ had a few broken filaments and because of threadline breaks spinning continuity was certainly unacceptable for commercial operation; both broken filaments and spinning breaks were even worse for the 9.6 MEQ even at 4000 ypm spinning. At 3500 ypm only for the 9.6 MEQ was spinning unacceptable because of broken filaments and breaks. At the higher concentrations of TES and at the higher speeds, Melt Fracture, a well known phenomenon, is the cause for the poor spinning.

Properties of the various yarns are summarized in Table 2A. The increase in orientation of the yarns and the increase in crystallinity with spinning speed are shown at each level of TES. The decrease in orientation with increasing TES is also shown.

Each yarn of Table 2A is textured on a Laboratory model of a Barmag FK6–6 using the same disc head and heater plate arrangements as used in Example 1, and at a speed of 615 mpm, the maximum speed recommended by Barmag for these texturing machines. The draw ratio for each yarn was selected so that the textured yarns would have about comparable properties. However, it was found that, for the higher concentrations of TES and the higher speed spun yarns, the draw ratio required was higher than estimated, and the denier of the textured yarns was lower than expected at the time the yarns were spun. Operability was excellent, especially for the DTFYS with the lower concentration of TES, and judged to be much better than for the control.

Figure 2:
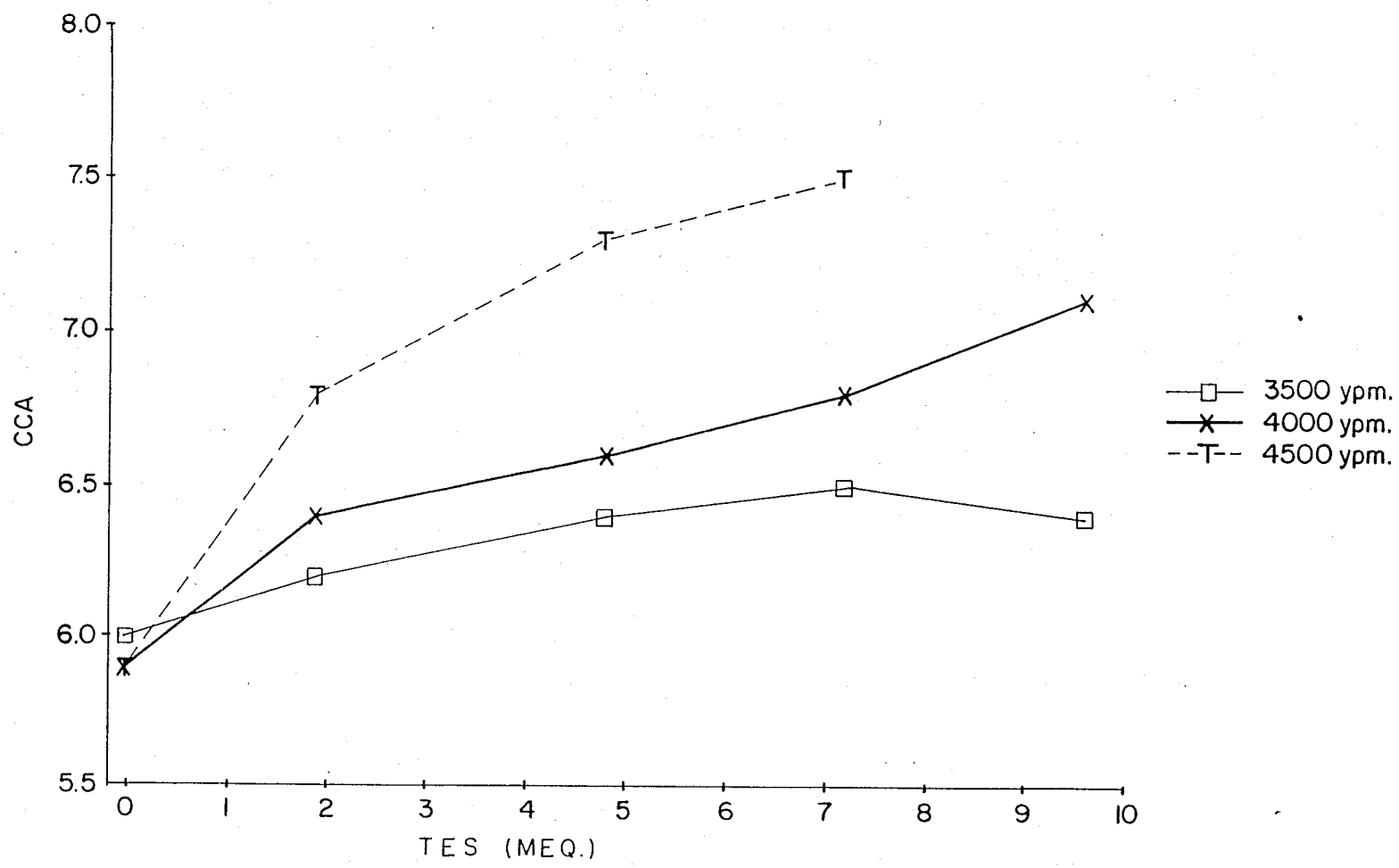
FIG. 2 is a graph plotting crimp properties (CCA) against the amount of chain-brancher used in Example 2.

The CCA column in Table 2B shows that the crimp of the new yarns improves as the TES content increases. This is also shown by FIG. 2 which is a plot of CCA vs. the TES content in MEQ for each of the spinning speeds. Clearly the higher values are usually found with higher TES content. Further at the 615 mpm texturing speed the higher speed spun DTFYS give the higher CCA values. While the higher TES contents and higher speeds would be preferred from the crimp properties, spinning difficulties preclude the use of higher concentrations than about 7 MEQ for spinning at 3500 ypm, about 4.8 MEQ for 4000 ypm and about 1.9 for 4500 ypm as shown by FIG. 1. At this low texturing speed of about 615 mpm. the broken filaments of these yarns were all very good except those with higher than about 7.2 MEQ, the result of the high broken filament level in the DTFY.

TABLE 2A

| Item | TES (MEQ) | % TES | Spin Speed (YPM) | Den. | Ten. | Elong. | Tenacity at Break | BOS % | Biref. | CI |
|---|---|---|---|---|---|---|---|---|---|---|
| A | 0 | 0 | 3500 | 248 | 2.48 | 127 | 5.63 | 65 | .0417 | 5 |
| A-1 | 0 | 0 | 4000 | 217 | 2.83 | 101 | 5.69 | 63 | .0576 | 6 |
| A-2 | 0 | 0 | 4500 | 193 | 3.21 | 82 | 5.84 | 57 | .0730 | 9 |
| B | 1.92 | 0.02 | 3500 | 250 | 2.45 | 135 | 5.76 | 62 | .0382 | 5 |
| B-1 | 1.92 | 0.02 | 4000 | 217 | 2.72 | 110 | 5.71 | 46 | .0469 | 10 |
| B-2 | 1.92 | 0.02 | 4500 | 193 | 2.85 | 95 | 5.56 | 17 | .0582 | 16 |

TABLE 2A-continued

| Item | TES (MEQ) | % TES | Spin Speed (YPM) | Den. | Ten. | Elong. | Tenacity at Break | BOS % | Biref. | CI |
|---|---|---|---|---|---|---|---|---|---|---|
| C | 4.80 | 0.05 | 3500 | 249 | 2.20 | 151 | 5.52 | 46 | .0270 | 6 |
| C-1 | 4.80 | 0.05 | 4000 | 219 | 2.33 | 131 | 5.38 | 26 | .0355 | 11 |
| C-2 | 4.80 | 0.05 | 4500 | 194 | 2.45 | 118 | 5.34 | 8 | .0507 | 19 |
| D | 7.20 | 0.075 | 3500 | 249 | 2.04 | 160 | 5.30 | 38 | .0252 | 12 |
| D-1 | 7.20 | 0.075 | 4000 | 218 | 2.12 | 150 | 5.30 | 17 | .0338 | 16 |
| D-2 | 7.20 | 0.075 | 4500 | 194 | 2.15 | 133 | 5.01 | 7 | .0437 | 20 |
| E | 9.6 | 0.10 | 3500 | 246 | 1.94 | 167 | 5.18 | 38 | .0242 | 12 |
| E-1 | 9.6 | 0.10 | 4000 | 216 | 1.88 | 156 | 4.81 | 15 | .0324 | 18 |

TABLE 2B

| % TES | TES MEQ | SPIN SPEED YPM | DRAW RATIO | Tensions Pre | Tensions Post | CCA | DENIER | TEN | ELONG | % DYE ATM |
|---|---|---|---|---|---|---|---|---|---|---|
| 0 | 0 | 3500 | 1.73 | 49 | 50 | 6.0 | 159 | 4.1 | 24 | 96 |
| 0 | 0 | 4000 | 1.50 | 47 | 47 | 5.9 | 162 | 3.9 | 26 | 101 |
| 0 | 0 | 4500 | 1.32 | 45 | 46 | 5.9 | 164 | 3.9 | 28 | 89 |
| 0.02 | 1.9 | 3500 | 1.73 | 49 | 50 | 6.2 | 161 | 3.9 | 26 | 110 |
| 0.02 | 1.9 | 4000 | 1.50 | 44 | 44 | 6.4 | 161 | 3.7 | 31 | 105 |
| 0.02 | 1.9 | 4500 | 1.39 | 49 | 50 | 6.8 | 150 | 3.7 | 30 | 152 |
| 0.05 | 4.8 | 3500 | 1.73 | 47 | 47 | 6.4 | 161 | 3.5 | 32 | 147 |
| 0.05 | 4.8 | 4000 | 1.58 | 44 | 45 | 6.6 | 154 | 3.4 | 33 | 151 |
| 0.05 | 4.8 | 4500 | 1.53 | 49 | 50 | 7.3 | 141 | 3.1 | 30 | 222 |
| 0.075 | 7.2 | 3500 | 1.73 | 45 | 48 | 6.5 | 159 | 3.1 | 36 | 175 |
| 0.075 | 7.2 | 4000 | 1.66 | 46 | 48 | 6.8 | 146 | 3.0 | 33 | 207 |
| 0.075 | 7.2 | 4500 | 1.53 | 44 | 46 | 7.5 | 136 | 2.9 | 36 | 245 |
| 0.10 | 9.6 | 3500 | 1.73 | 46 | 47 | 6.4 | 159 | 3.0 | 37 | 203 |
| 0.10 | 9.6 | 4000 | 1.73 | 50 | 53 | 7.1 | 140 | 2.9 | 31 | 244 |

I claim:

1. A continuous process for preparing polyester draw-texturing feed years, involving the steps of first forming a molten polyester by reaction, in the presence of catalysts therefor, (a) of ethylene glycol with terephthalic acid, esters, or both, thereof, followed by (b) polycondensation and then melt-spinning the resulting molten polyester into filaments and withdrawing them at a speed of about 3,000 to 4,000 mpm to provide partially oriented yarns of low crystallinity, wherein the polyester is modified by introducing into the polymer, as a solution in ethylene glycol, tetraethyl silicate in a small amount, measured as microequivalents per gram of polymer (MEQ), that depends on the speed (V), in ypm at which the filaments are withdrawn, the optimum amounts being as indicated by the line AB of FIG. 1 of the accompanying drawings.

2. A process according to claim 1, wherein the filaments are withdrawn at a speed of about 3,000–3,200 mpm.

3. A process for preparing a false-twist-textured yarn, wherein a multifilament polyester feed yarn is subjected to simultaneous draw-texturing at a speed of at least 500 mpm, the feed yarn consists essentially of polymerized ethylene terephthalate residues and of oxysilicate residues acting as a chain brancher, and the resulting package of textured yarn has not more than about 0.5 BFC, and over 20 TYT, wherein said feed yarn is prepared by melt spinning a molten polyester into filaments and withdrawing them at a speed of about 3,000 to 4,000 mpm to provide a partially oriented yarn of low crystallinity, wherein the polyester is modified by introducing into the polymer, as a solution in ethylene glycol, tetraethyl silicate in a small amount, measured as microequivalents per gram of polymer (MEQ), that depends on the speed (V), in ypm, at which the filaments are withdrawn, the optimum amounts being as indicated by the line AB of FIG. 1 of the accompanying drawings.

* * * * *